US006234924B1

(12) United States Patent
Washburn, Jr.

(10) Patent No.: US 6,234,924 B1
(45) **Date of Patent: *May 22, 2001**

(54) ARTIFICIAL BAT END DEVICE

(76) Inventor: Van H. Washburn, Jr., 1025 W. Gates Dr., Roosevelt, UT (US) 84066

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/982,810

(22) Filed: Dec. 2, 1997

(51) Int. Cl.[7] ..... A63B 59/06
(52) U.S. Cl. ..... 473/568; 473/457
(58) Field of Search ..... 473/457, 568, 473/564

(56) References Cited

U.S. PATENT DOCUMENTS

| | | | | |
|---|---|---|---|---|
| 3,469,839 | * | 9/1969 | Pietronuto et al. | 473/564 |
| 5,482,270 | * | 1/1996 | Smith | 473/568 |
| 5,577,722 | * | 11/1996 | Glassberg | 473/568 |
| 5,624,114 | * | 4/1997 | Kelsey | 473/457 |

* cited by examiner

*Primary Examiner*—Mark S. Graham

(57) ABSTRACT

An artificial bat end device for temporarily adjusting the length of a bat by using an adjustable ring having a thickness sufficient to simulate the butt end of a bat with the ring also having the capability to conform to the handle of a bat and be forcibly held in place on the bat's handle.

2 Claims, 2 Drawing Sheets

ARTIFICIAL BAT END DEVICE

BACKGROUND OF THE INVENTION

1. The Field of the Invention

The present invention concerns a device capable of temporarily adjusting the length of a bat by using an adjustable ring.

2. Description of the Prior Art

Every baseball and softball player understands the basic rule that a bat's swing speed greatly determines a batter's effectiveness. The faster the swing, the more likely a batter is to make contact with a given pitch. Baseball and softball players also inherently understand that the bat's swing speed is a function of not only how hard the batter swings, but of the bat's length and mass.

Ideally, every player and coach would have access to the perfect bat for any given batting situation. When a pitcher was not throwing particularly fast and a batter did not need a high swing speed, a longer and heavier bat would be used. When the opposite was true, that is when the pitcher threw very fast, or even just when a batter fell behind in the strike count and higher bat swing speed was desired, a shorter and/or lighter bat would be selected. While professional baseball and softball players may find it practical to have many bats for any given situation, the cost is not efficient for other, more recreational settings.

Instead, most players and their teams have only a handful of bats to suit all of their varied needs. This leads to the common, and often futile admonition from coaches and teammates for a batter to choke-up. This well understood, but often unheeded instruction is a directive for the batter to move his hands up from the bottom of the bat's handle. If done, this shortens the effective bat length, thereby automatically creating a higher bat swing speed with the batters natural swing. Typically, even if this instruction is followed for the first pitch, the batter may well return on subsequent pitches to the more natural position of having their hands rest at the end of the handle.

One possible solution to this problem is to create an artificial handle end at a desired point on the handle with wound tape, or other similar material. This, however, is not an ideal solution. Since the bat will be used by players of varying physical size, the different players will want and need different lengths to optimize the bat's use. This will require constant winding and unwinding a tape. Since the tape is typically very thin and the desired artificial handle end must have considerable thickness before it becomes really effective. Additionally, the tape's adhesive will build up on the handle, creating an essentially unworkable solution.

Many patented devices exist for helping batter's improve their performance. For example, U.S. Pat. Nos. 5,653,440, 5,501,450 and 4,898,384 each teach the addition of extra mass to a baseball bat to aid in the development of a proper swing. However, the need to help batters choke-up has remained unaddressed.

SUMMARY AND OBJECTS OF THE INVENTION

It is the object of the present invention to provide a device capable of temporarily and easily adjusting the effective length of a bat.

It is a further object of the invention to provide a device capable of helping batters choke-up on a bat handle.

It is another object of the invention to eliminate the need for having multiple bats available to accommodate different sized batters.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
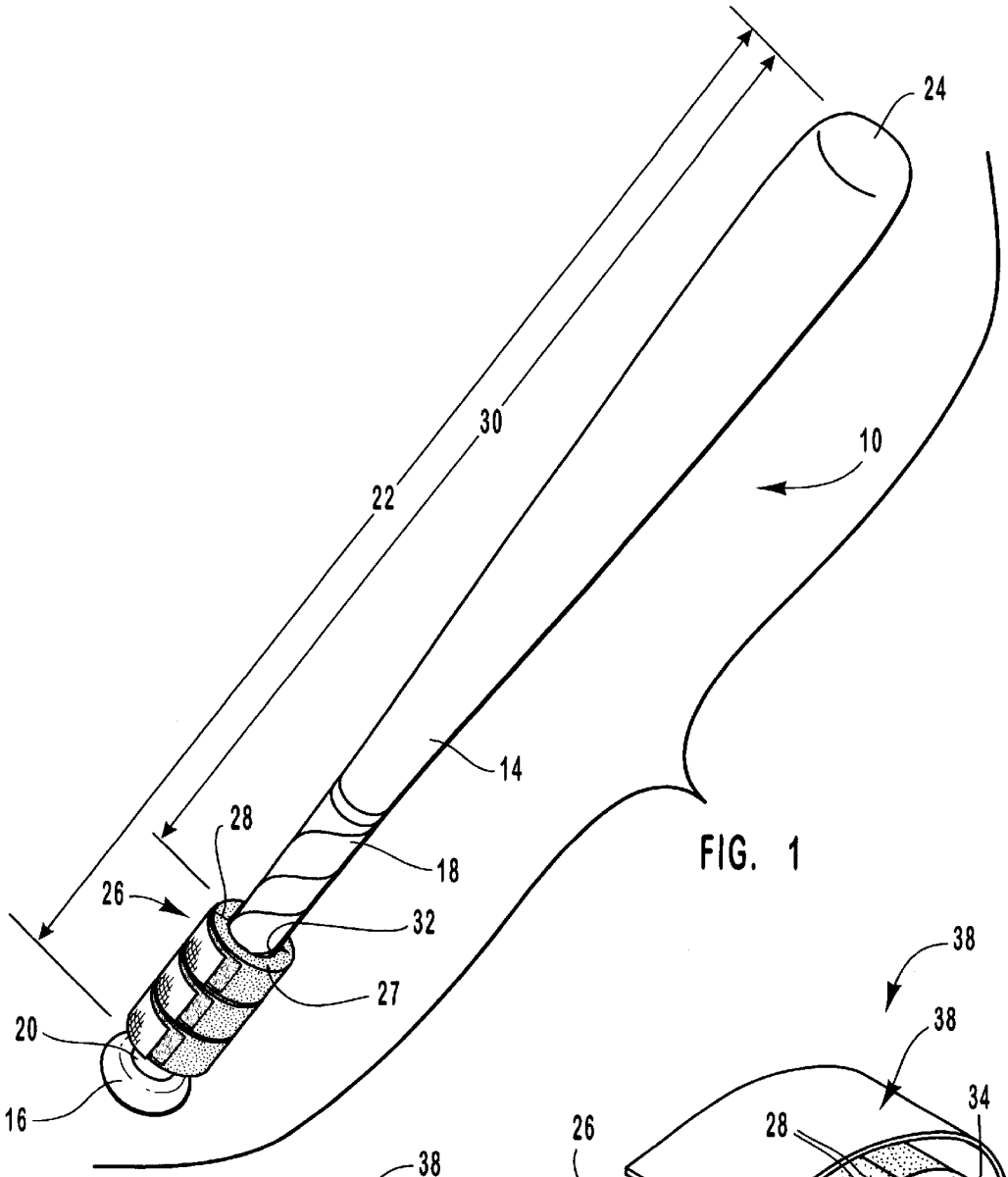
FIG. 1 is a perspective views of an artificial bat end secured on a bat handle.

FIG. 1 shows a bat 10 comprising a barrel 12, a handle 14 and a butt end 16. As is typical for any bat and as can be readily observed from the drawing, the diameter of the barrel 12 is significantly greater than the diameter of either the handle 14 or the butt end 16, and the butt end's diameter is greater than the handle's diameter. A grip 18 is wound around the handle's diameter and extends up from the handle's end 20, which is the point where the butt end 16 meets the handle 14. The bat's length 22 can be defined as the distance from the handle's end 20 to the barrel's opposite end 24. Removably attached to the handle's grip 18 is an artificial bat end 26 whose thickness 28 when added to the handle's diameter simulates the diameter of the butt end 16. With the artificial bat end 26 in place, the effective bat length 30 can be defined as the distance from the handle's temporary new end 32 to the barrel's opposite end 24.

FIGS. 2 through 5 provide perspective views of different embodiments for the artificial bat end. In each embodiment the adjustable bat end 26 has a band 27 with a thickness 28 that separates an inside surface 34 and an outside surface 36. This thickness 28 allows the band 27 to simulate the diameter of the bat's butt end 16 and prevent a user's hands from moving down the bat handle. In addition, each adjustable bat end 26 has a constrictor 38 capable of applying force to the band's inside surface 34 to prevent the adjustable bat end 26 from moving along the bat's handle 14. The ability to apply sufficient force to the band 27, allows it to be secured at any point on the handle 14, and thereby does not limit the artificial bat end by requiring it to rest on the bat's butt end 16.

The constrictor can use mechanical, physical or chemical means to supply the needed force. Such means as a constrictor, which is separate from the band 27, made of Velcro, containing snaps or buttons, or even having a suitable adhesive are all within the present invention's scope. It is also possible that the band 27 and constrictor 38 can be part of the same physical piece, with the band providing the needed thickness 28 and the constrictor applying the needed force to secure the adjustable bat end to the bat's handle.

Additionally, the inside surface 34 can employ gripping means such as velcro or chemical adhesives to help secure the adjustable bat end 26 to the handle 14. Each embodiment shows a different way to adjust the inside surface 34 so that it can conform to and around the bat's handle 14 and different sized and configured constrictors 38.

Figure 2:
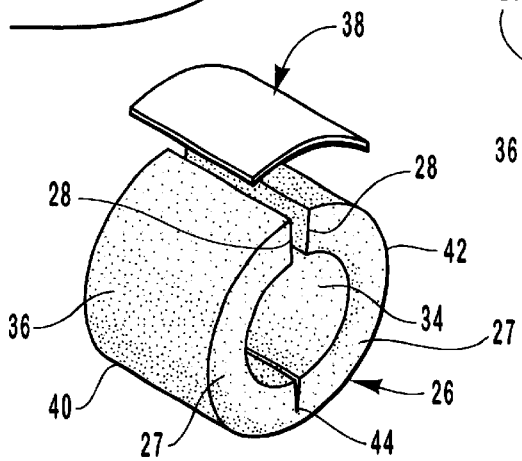
FIGS. 2 to 5 are perspective views of various embodiments of the present invention.

In FIG. 2, two essentially half rings 40 and 42 are connected together at one end 44 to create a band 27 with an adjustable inside surface 34 that is held against the bat handle (not shown) when closed by means of a constrictor 38.

Figure 3:
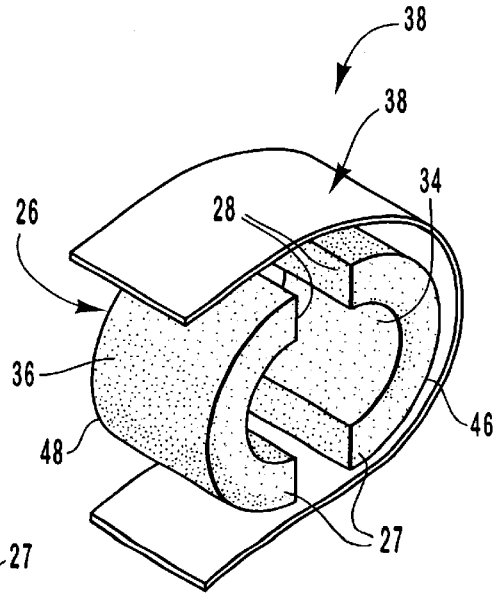

In FIG. 3, shows an embodiment similar to FIG. 2, except that the two essentially half rings 46 and 48 are separate, but both come together to create a band 27 with an adjustable inside surface 34 that is held against the bat handle (not shown) by means of a constrictor 38.

Figure 4:
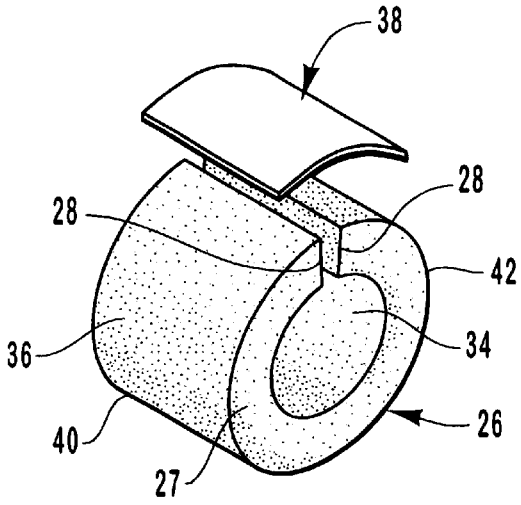

FIG. 4 shows a single noncontinuous ring which is a band 27 with an adjustable inside surface 34 that is held against the bat handle (not shown) when closed by means of a constrictor 38.

Figure 5:
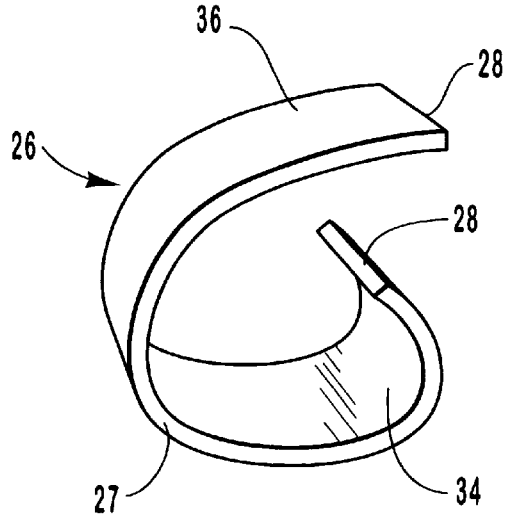

The embodiment of FIG. 5 shows a band 27 with an adjustable inside surface 34 separated from the outside surface 36, to the by a thickness 28. As the adjustable bat end's inside surface 34 wraps around the bat's handle (not shown) the inside and outside surfaces 34 and 36 work together to act as the constrictor. The inside surface 34 can secure itself to the outside surface 36 once the adjustable bat end is wrapped around the bat's handle thereby holding the two surfaces together with sufficient force to prevent the adjustable bat end 26 from moving along the bat's handle 14.

Figure 6:
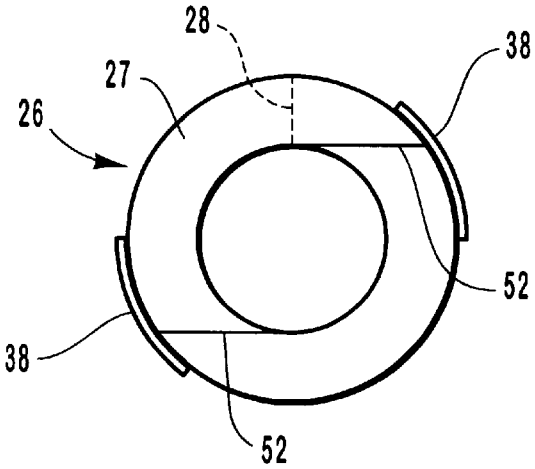
FIGS. 6 and 7 are frontal views of other invention embodiments.

FIG. 6 shows a front view of an artificial bat end 26 with tangential openings 52 and two constrictors 38, instead of the radial openings and one constrictor of FIGS. 2 to 4.

Figure 7:
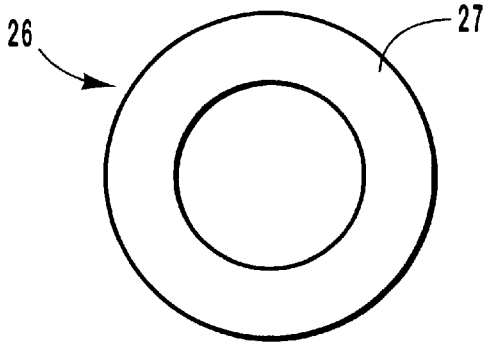

FIG. 7 shows a front view of an artificial bat end 26 with a continuous band 27. The constrictor of this embodiment can be enclosed inside the band 27, so long as it is capable of exerting sufficient force to hold the band 27 against the bat handle (not shown).

While many inventions teach methods and devices for securing a weighted ring or band, on the barrel end of a bat to increase the bat's weight, this invention provides an adjustable band capable of enclosing the handle of a bat such that this adjustable band can create an artificial bat end which simulates the bat's butt end and can be placed at any point along the bat's handle. By so simulating the bat butt end, this invention can vary the effective length of any bat, without any permanent changes to the bat itself.

What is claimed and desired to be secured by United States Letters Patent is:

1. An artificial bat end comprising:

(a) a noncontinuous adjustable band, said band having a thickness sufficient to simulate a butt end of a bat; and (b) a constrictor having a left and a right end, wherein one of said left and right end of said constrictor is permanently attached to said band and wherein said constrictor further has a hook and loop fastener gripping surface, said hook and loop fastener gripping surface of said constrictor attaching to said band and being capable of applying sufficient force to said band to releasably secure said band on a handle of a bat such that said band can be independently secured at any point along a handle of a bat to prevent easy axial movement of a bat band along said handle.

2. An artificial bat end comprising:

(a) a noncontinuous adjustable band, said band having a thickness sufficient to simulate a butt end of a bat; and (b) a constrictor having a left and a right end, wherein one of said left and right end of said constrictor is permanently attached to said band and wherein said constrictor further has at least one snap, said snap being capable of attaching to said band and being capable of applying sufficient force to said band to releasably secure said band on a handle of a bat such that said band can be independently secured at any point along a handle of a bat to prevent easy axial movement of said band along a bat handle.

* * * * *